United States Patent [19]

Klein et al.

[11] 4,001,652

[45] Jan. 4, 1977

[54] GROUND FAULT RECEPTACLE WITH IMPROVED STATIONARY CONTACT MOUNTING AND BACKING

[75] Inventors: Keith W. Klein, Simsbury; Joseph M. Palmieri, Southington, both of Conn.

[73] Assignee: General Electric Company, New York, N.Y.

[22] Filed: Oct. 22, 1975

[21] Appl. No.: 624,998

[52] U.S. Cl. ..... 317/112; 335/18; 317/18 D

[51] Int. Cl.[2] ..... H01H 73/06

[58] Field of Search ..... 317/112, 180; 335/18; 200/51 R

[56] References Cited

UNITED STATES PATENTS

| | | | |
|---|---|---|---|
| 3,789,268 | 1/1974 | Klein | 317/18 D |
| 3,898,528 | 8/1975 | Runtsch | 317/18 D |
| 3,950,677 | 4/1976 | Klein | 317/18 D |

*Primary Examiner*—Gerald P. Tolin
*Attorney, Agent, or Firm*—Robert A. Cahill; Walter C. Bernkopf; Frank L. Neuhauser

[57] ABSTRACT

An electrical receptacle assembly affording ground fault protection includes a housing containing fixed contacts supported by socket connector sub-assemblies. A support plate mounts an electronics/magnetics module and operating mechanism sub-assembly including a pivotal, movable contact carrying arm, a latch, a reset button and a trip solenoid. The reset button positions the latch to detain the arm with the contacts in circuit completing relation. On a ground fault, the module effectuates energization of the solenoid to unlatch the arm which moves to separate the contacts.

7 Claims, 18 Drawing Figures

FIG. 1
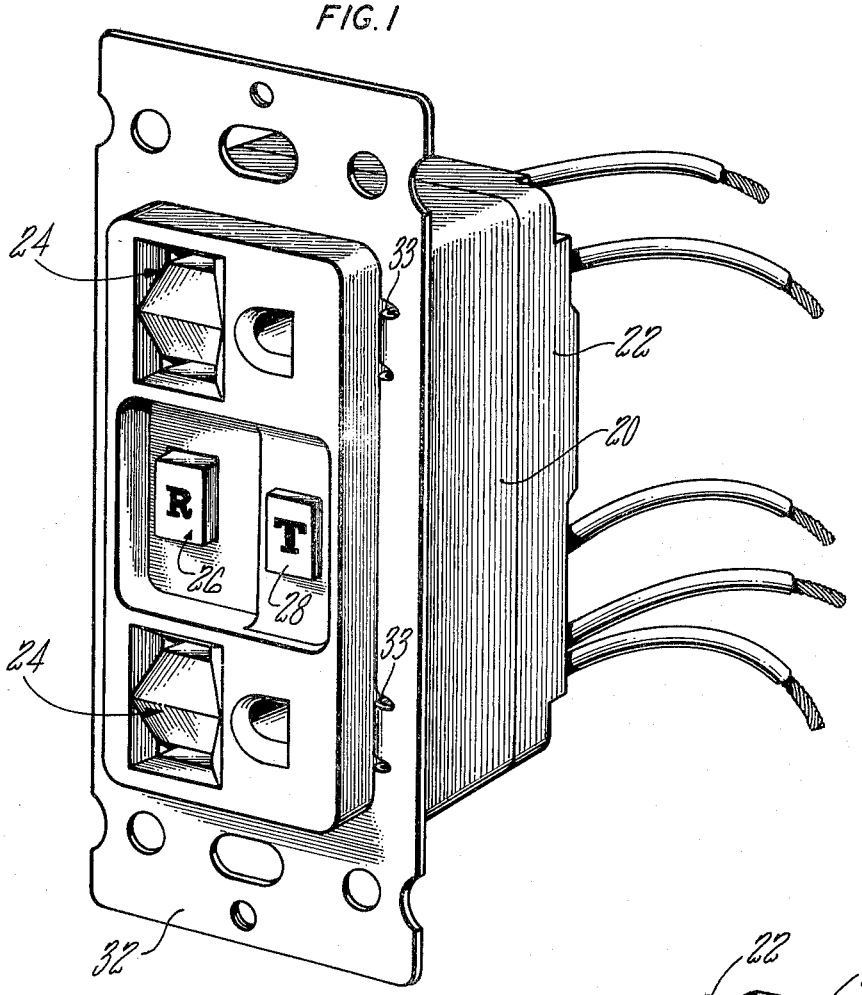
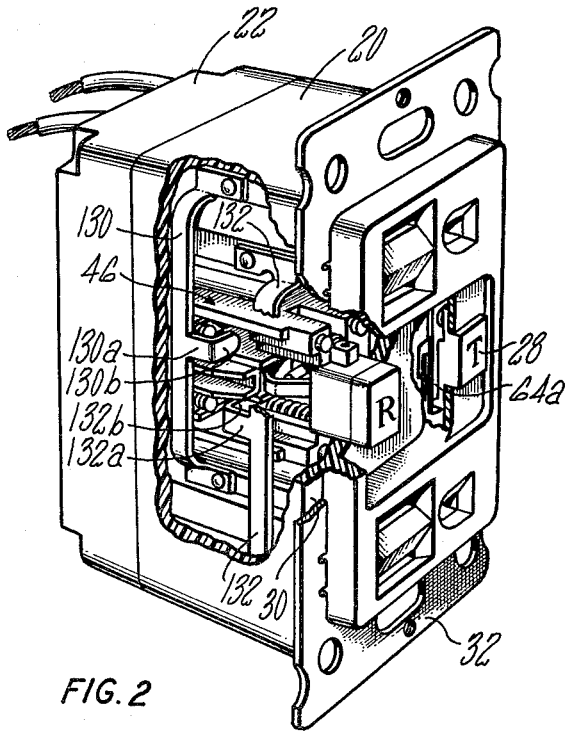
FIG. 2

FIG.6
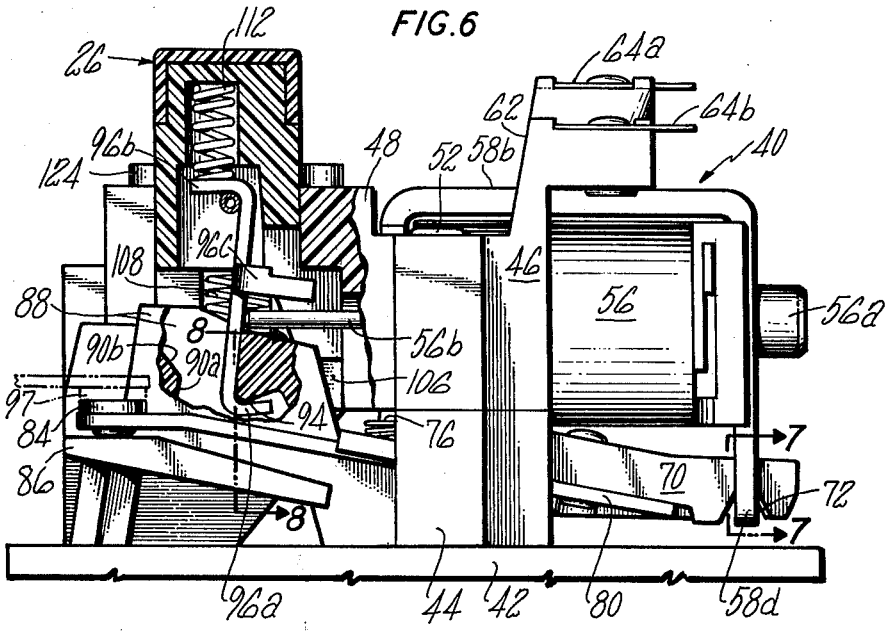
FIG.8
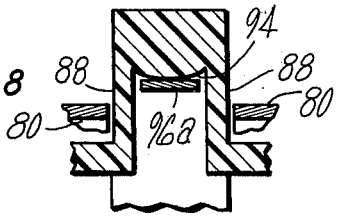
FIG.7
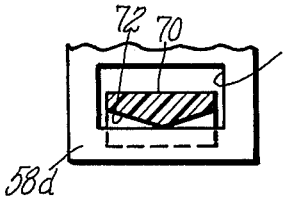
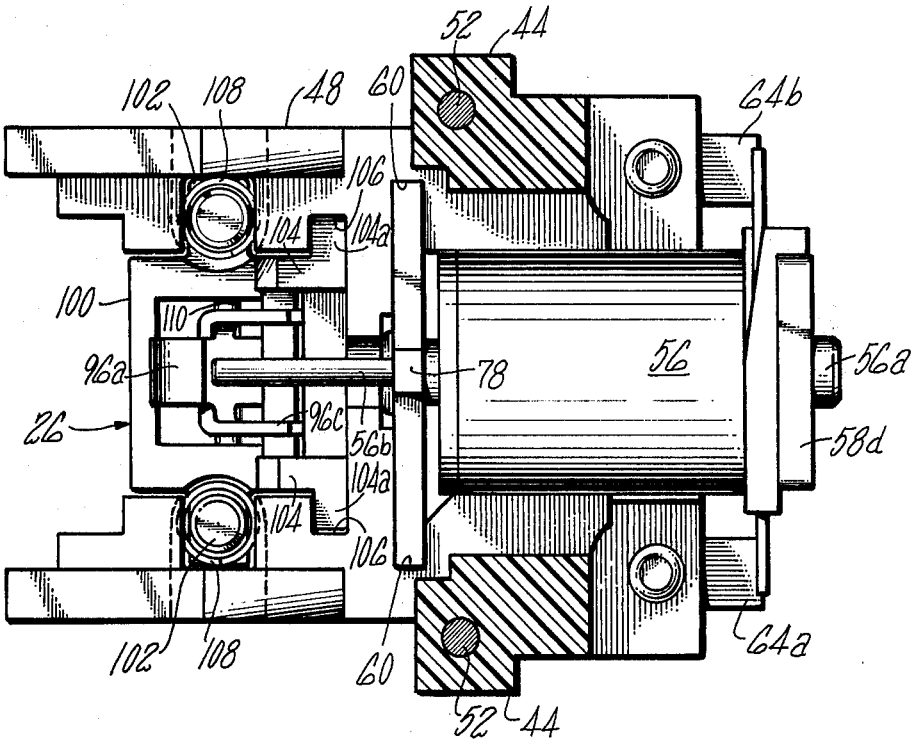
FIG.9

154
156
156a
160
186
44
42
158
158a
151
158b
158c
162
164a
166
170
168
164
16
15
174
175
166a
158b
170a
175a
172
171
142

GROUND FAULT RECEPTACLE WITH IMPROVED STATIONARY CONTACT MOUNTING AND BACKING

BACKGROUND OF THE INVENTION

The present invention relates to ground fault circuit interrupting (GFCI) devices in receptacle configurations conducive to implementation as wall outlets in conventional low voltage electrical power distribution systems found in homes and offices. Ground fault protection in circuit breaker configurations has been available for some time, wherein the GFCI circuit breakers are simply substituted for conventional circuit breakers in the service entry panelboard. These GFCI circuit breakers are also equipped with short circuit and overload tripping capabilities, and thus protection against injurious electrical shock from ground faults is achieved without any sacrifice in circuit protection. However, many existing power distribution circuits rely on fuses for circuit protection, and thus ground fault protection using GFCI circuit breakers is impractical. Moreover, the installation of GFCI circuit breakers in a service entry panelboard by other than an electrician is potentially hazardous.

It is accordingly an object of the present invention to provide an electrical receptacle having ground fault protection capability.

An additional object of the invention is to provide an electrical receptacle of the above character which is of a unique, compact construction readily conducive to being installed in existing outlet boxes in place of conventional electrical receptacles.

A further object is to provide an electrical receptacle of the above character having a novel arrangement of parts affording economies in manufacture, both in terms of fabrication and assembly.

Other objects of the invention will in part be obvious and in part appear hereinafter.

SUMMARY OF THE INVENTION

In accordance with the present invention there is provided an electrical receptacle equipped to provide ground fault protection. The receptacle includes an insulative housing consisting of a base and a shallow back cover. The base supports a pair of socket connector sub-assemblies accessible for accepting conventional appliance cord plugs. Each connector subassembly includes a pair of stab connectors electrically interconnected by a rigid conductive strap which, in turn, mounts a fixed contact. A mounting plate positionally mounted proximate the junction of the base and cover sections the housing into a GFCI module chamber, largely defined by the cover, and a contact operating mechanism, largely defined by the base.

More specifically, the mounting plate is configured on its module chamber side to positionally mount magnetics inductively coupled with the line and neutral sides of a distribution circuit and the requisite electronics for processing signals developed by the magnetics in response to a ground fault condition. The operating mechanism, mounted to the other side of the mounting plate, includes a mounting block for supporting the various mechanism parts as a unitary sub-asssembly. Thus, the mounting block supports a reciprocating reset operator, a trip solenoid and a pivotal arm which carries a pair of movable contacts. Springs bias the reset operator outwardly through an opening in the front wall of the base. A latch pivotally mounted by the reset operator is positioned upon depression of the operator to engage the contact arm which is then elevated by the operator springs to bring the movable contacts into engagement with the fixed contacts and thereby energize the socket connectors.

In the event of a ground fault producing a ground leakage current exceeding a predetermined magnitude, the module causes the trip solenoid to be energized. The solenoid plunger strikes the latch, releasing the arm which moves by spring pressure to separate the contacts and de-energize the socket connectors, together with the load connected thereto. The operator is moved by its springs to a position of extreme protrusion through the base, manifesting that receptacle power has been interrupted. Once the ground fault condition has been remedied, the operator is depressed to latch up the contact arm and restore receptacle power.

The invention accordingly comprises the features of construction and arrangement of parts which will be exemplified in the construction hereinafter set forth, and the scope of the invention will be indicated in the claims.

For fuller understanding of the nature and objects of the present invention, reference should be had to the following detailed description taken in conjunction with the accompanying drawings, in which:

FIG. 1 is a perspective view of the electrical receptacle constructed in accordance with the present invention;

FIG. 2 is a perspective view, partially broken away, of the receptacle of FIG. 1;

FIG. 6 is a side elevational view, partially broken away, of the contact operating mechanism in its closed circuit condition;

FIG. 7 is a sectional view taken along line 7—7 of FIG. 6;

FIG. 8 is a sectional view taken along line 8—8 of FIG. 6;

FIG. 9 is a sectional view taken along line 9—9 of FIG. 4, with pivotal contact arm removed;

Like reference numerals refer to like parts throughout the several views of the drawings.

DETAILED DESCRIPTION

Figure 10:
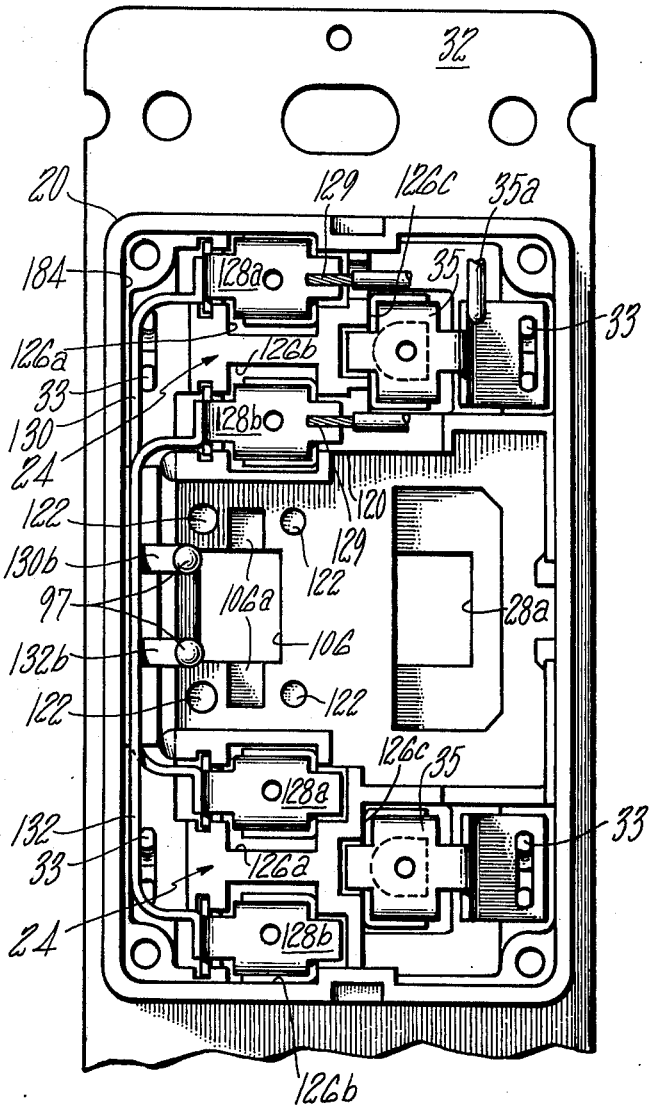
FIG. 10 is a bottom view of the receptacle base seen in FIG. 3.

The electrical receptacle of the present invention, as seen in FIG. 1, includes an insulative housing consisting of a deep base 20 and a shallow back cover 22 molded of suitable insulative plastic material. The front wall of base 20 is formed with a plurality of slotted openings into the base interior arranged to provide a pair of female sockets, each generally indicated at 24, in traditional duplex receptacle fashion for receiving conventional two and three-pronged appliance cord plugs. The central recessed portion of the base front wall is formed having apertures through which a reset operator 26 and a test button 28 protrude for convenient digital manipulation. The sidewalls of base 20 are provided with shoulders 30 (FIG. 2) for seating a conductive mounting plate 32 utilized in installing the receptacle in a conventional wall outlet box. Tabs 33 formed with the mounting plate project through slots formed at the junction of shoulders 30 with the base sidewalls and are staked in electrical connection with a female stab connector 35 (FIG. 10) positioned within the base immediately behind the ground prong slot of each receptacle socket 24. Tabs 33 on the other side of the mounting plate 32 likewise penetrate openings in the base and are simply staked to the base front wall, as also seen in FIG. 10. In this manner, the mounting plate is securely affixed to the receptacle housing and also serves to connect the ground stab connectors in common. Moreover, the staking of tabs 33 serves to hold the connectors 35 in place within base 20. Thus, upon installation of the receptacle in metallic stab outlet box, the mounting plate serves to complete a ground circuit path between connectors 35 and two-wire metallic jacketed cable via the outlet box. If the outlet is wired with three wire, insulation jacketed cable, the third ground wire is electrically connected to one of the wires emanating through the back cover 22 electrically connected at its inner end to one of the stab connectors 35, as indicated at 35*a* in FIG. 10. The other wires seen in FIG. 1 emanating through the back cover 22 facilitate connection of the receptacle into the distribution circuit in either a termination or feed-through configuration. In a termination configuration, only the loads plugged into the receptacle itself are afforded ground fault protection, whereas in a feed-through configuration ground fault protection is provided for conventional receptacles wired downstream from the ground fault protected receptacle.

Turning to FIGS. 3 through 9, an operating mechanism sub-assembly, generally indicated at 40, is affixed to a generally rectangular support plate 42 positionally mounted in base 20 proximate its junction with back cover 22. Plate 42 is formed with a pair of laterally spaced pedestals 44 (FIGS. 3 and 6) on which is seated a mounting block, generally indicated at 46, supporting the various operating mechanism parts. Mounting block 46 is formed having laterally spaced sidewalls 48 in which are provided vertical columns 50 resting on pedestals 44. The columns 50 and pedestals 44 are formed with aligned through bores which receive rivets 52 serving to affix the operating mechanism sub-assembly 44 to mounting plate 42. Mounting block 46 is additionally provided with laterally spaced feet 49 which rest on the upper surface of plate 42 to give the operating mechanism sub-assembly a stable four point stance.

Figure 3:
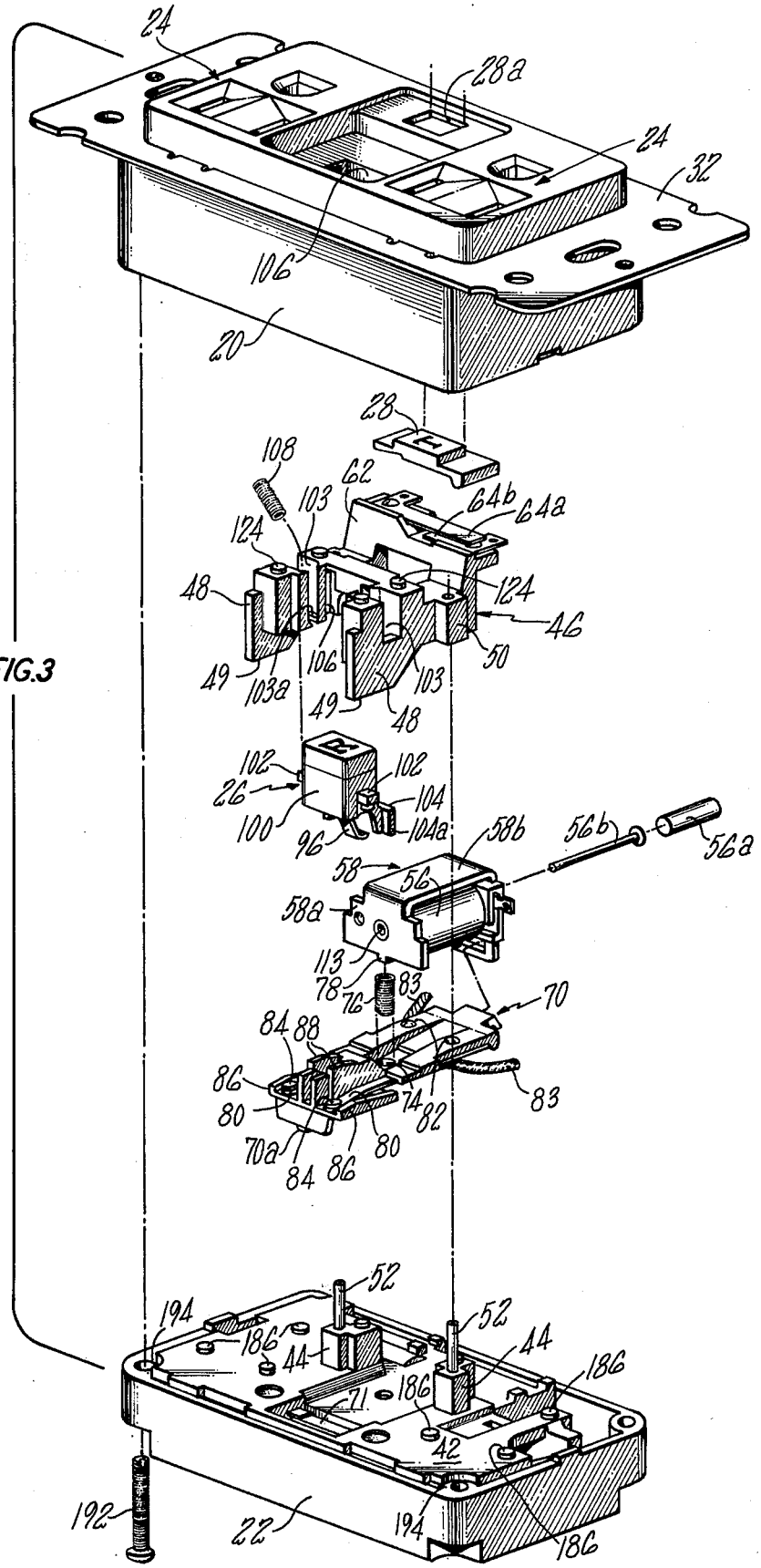
FIG. 3 is an exploded perspective view of the receptacle of FIG. 1.

A trip solenoid sub-assembly, as best seen in FIG. 3, includes a solenoid coil 56 mounted in an inverted U-shaped magnetic frame 58. The left depending leg 58*a* of magnetic frame 58 is of enlarged width such that its lateral edge portions provide flanges for receipt from below in opposed, vertical grooves 60 formed in sidewalls 48 (FIG. 9) The resulting shoulders at the junction of leg 58*a* and bight 58*b* of the magnetic frame are staked, as indicated at 58*c* in FIG. 5, to prevent the trip solenoid sub-assembly from sliding downwardly out of grooves 60. Upward dislocation of the trip solenoid sub-assembly is prevented by an upper transverse bridging segment 62 spanning the mounting block sidewalls 48 immediately above the frame bight 58*b*.

Bridging segment 62, in its extension between the mounting block sidewalls 48, is formed in a two-tiered upper surface configuration for mounting a pair of reed switch contacts 64*a*, 64*b* (FIGS. 4 and 5) Upon positioning of the operating mechanism sub-assembly 40 within cover 20, elongated switch contact 64*a* is located immediately beneath test button 28 captured in base front wall opening 28*a* (FIGS. 3 and 10). Upon depression of test button 28, the contact 64*a* is flexed into engagement with contact 64*b* to complete a circuit path causing simulated ground leakage current to flow. Thus, depression of the test button should cause the receptacle to trip and de-energize its sockets 24. This approach to testing ground fault circuit interrupting devices for operability is well known in the art.

Figure 4:
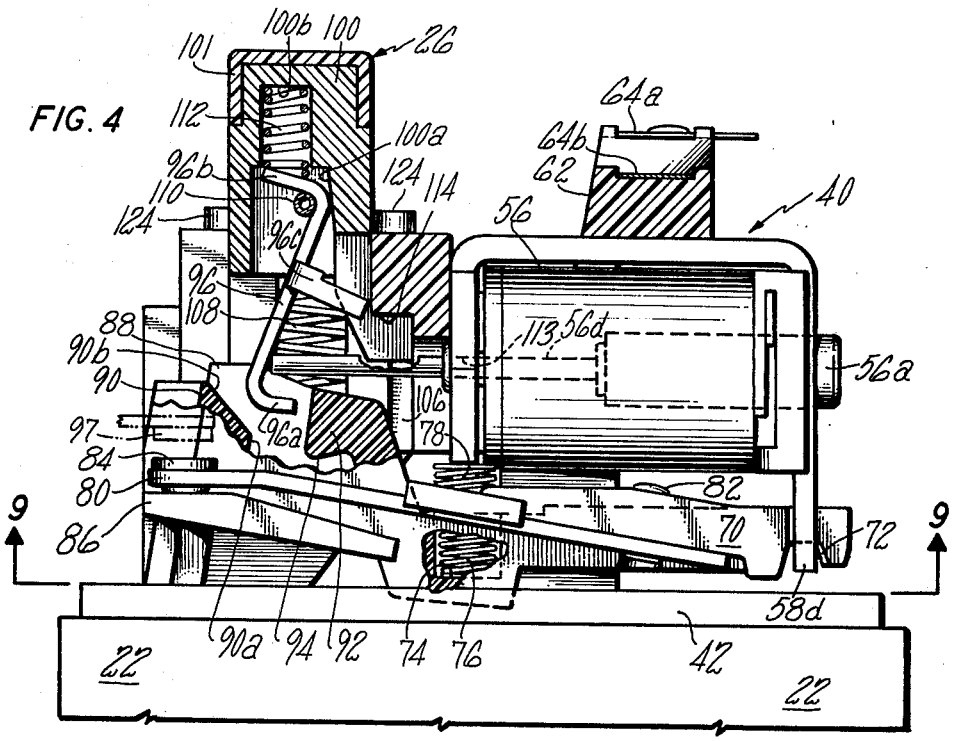
FIG. 4 is a side elevational view, partially broken away, of the contact operating mechanism incorporated in the receptacle of FIG. 1, wherein the mechanism is in its open circuit condition.

An elongated arm 70 seen in FIGS. 3, 4 and 6, is disposed between mounting block 46 and mounting plate 42 for extension between the pedestals 44 and the mounting block feet 54. The right end of arm 70 extends through a rectangular opening 71 (FIG. 7) formed in a downward extension of magnetic frame leg 58*d*. Spaced inwardly from the right leg of arm 70 is a downwardly opening notch 72 in which is engaged the bottom edge of rectangular opening 71 to inhibit fore and aft arm movement. As seen in FIG. 7, the bottom surface of groove 72 is V-shaped in transverse cross section to accommodate limited rolling motion of the arm. Arm 70 is provided with a well 74 (FIG. 4) at approximately its mid-length for accommodating the lower portion of a compression spring 76. The upper end portion of spring 76 embraces a tit 78 (FIGS. 4 and 9) depending from the bottom edge of magnetic frame lg 58*a*. From the description thus far, it is seen that arm 70 is pivotally mounted adjacent its right end in the lower extension of magnetic frame leg 58*d*, with spring 76 urging the left arm of the arm downwardly toward mounting plate 42.

Arm 70 carries a pair of elongated conductive strips 80 (FIGS. 3, 4 and 6) which are secured in place by rivets 82. Conductive braids 83 (FIG. 3) connect the strips to the two sides of a power distribution circuit. The left ends of these strips carry fixed contacts 84 which receive backing from underlying laterally extending flanges 86 integrally formed with arm 70. Also integrally formed with arm 70 is a raised central portion intermediate contact strips 80 consisting of opposed sidewalls 88, and outer endwall 90 and an inner endwall 92. Formed in the inner endwall 92 is a latching surface 94 which is engaged by the lower hooked portion 96*a* of a latch 96 mounted by the reset operator 26. As seen in FIG. 8, latching surface 94 is crowned so as to cooperate with the inverted V-shaped groove bottom 72 at the other end of contact arm 70 in accommodating limited rolling motion of the contact arm. This accommodated rolling motion serves to equalize the contact pressures between movable contacts 84 and stationary contacts 97 seen in phantom in FIGS. 4 and 6.

Figure 5:
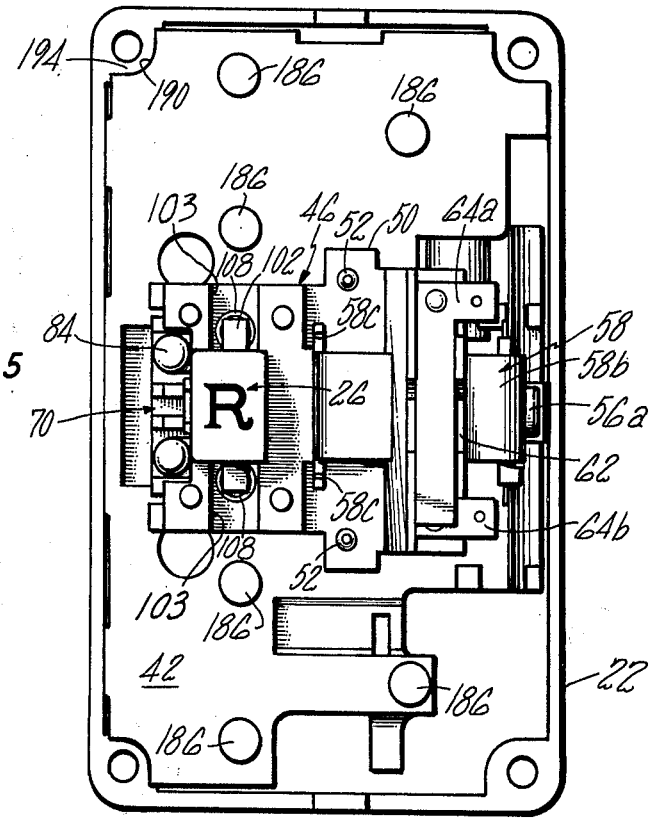
FIG. 5 is a top view of the operating mechanism of FIG. 4.

Reset operator 26 is formed having a body or button portion 100 having opposed laterally extending lugs 102 FIGS. 3, 5 and 9) which are loosely received in opposed, vertically extending slots 103 formed in sidewalls 48 of mounting block 46. Legs 104 depending from the operator body 100 are provided with laterally outwardly extending flanges 104*a* which are received in downwardly opening grooves 106 formed in the mounting block sidewall 48 (FIG. 9). It is thus seen, especially from FIG. 3, that operator 26 is assembled in mounting block 46 from below with lugs 102 received in sidewall slots 103 and flanges 104*a* received in sidewall grooves 106. Compression springs 108 seated by ledges 103*a* (FIG. 3) in the lower ends of slots 103 act on lugs 102 to bias the operator 26 upwardly for protrusion through the opening 106 (FIGS. 3 and 10) in the base front wall.

Latch 96, in addition to its hooked lower portion 96*a*, includes, as seen in FIGS. 4 and 6, an elongated body and an upper, laterally turned portion 96*b* which is hooked over a pin 110 transversely mounted in the operator body 100 to span a downwardly opening recess 100*a* formed therein. A compression spring 112 accommodated in a well 100*b* formed in the upper bottom of recess 100*a* acts on the upper latch portion 96*b* such as to bias the latch 96 for pivotal movement on pin 110 in the counterclockwise direction. It is thus seen that spring 112 urges the lower hooked portion 96*a* of latch 96 toward latching engagement with latching surface 94 of endwall 92 carried by the contact arm 70.

Trip solenoid coil 56 encompasses an armature 56*a* which, upon coil energization, is sucked inwardly or to the left, driving a plunger 56*b*, mounted in opening 113 in frame leg 58*a*, into impact with latch 96 at a point along its body portion just above the endwall 92 of contact arm 70 (FIGS. 4 and 6). It is thus seen that plunger 56*b* pivots latch 96 in the clockwise direction to disengage latch hook 96*a* from latching surface 94. As a consequence, arm 70 is released, and its spring 76 forces the left end of the arm together with its movable contacts 84 downwardly. Springs 108 then become operative to move the reset operator 26 upwardly through opening 106 in the base front wall. Reset operator body 100 is preferably provided with a distinctively colored cap 101 which is exposed above opening 106 while arm 70 is latch up in its closed circuit position. When arm 70 is unlatched by the trip solenoid, springs 108 elevate operator 26 to expose above opening 106 the portion of operator body 100 below cap 101, thus providing a visual trip indication.

To prevent a false trip indication in the event the contacts are welded together, latch 96 is provided with laterally extending arms 96*c* (FIGS. 4 and 6). If arm 70, upon being unlatched, fails to move downwardly to its open circuit position because of welded contacts, the hooked latch portion 96*a* is not clear of the inner vertical wall 90*a* when arms 96*c* encounter a corner 114 of mounting block 46 during elevation of reset operator 26 by its springs 108. As a consequence continued elevation of the reset operator is inhibited to prevent exposure above opening 106 of the operator body 100 beneath cap 101. It is seen that under normal circumstances unlatching of arm 70 results in its downward movement to an open circuit position, and, as a result, the vertical wall 90*a* drops below the hooked latch portion 96*a*. The sloping wall 90*b* above vertical wall 90*a* affords clearance for further pivotal movement of latch 96 as arms 96*c* engage corner 114 during elevation of reset operator 26. Thus, springs 108 are not inhibited from fully elevating the reset operator to its trip indicating position. As seen in FIG. 3, arm 70 includes a depending tap 70*a* which engages and opens a normally closed module power switch 71, carried by support slate 42, when the arm is in its open circuit position of FIG. 4. During initial elevation of arm 70 toward its closed circuit position, tap 70*a* releases switch 71, which closes to restore module power prior to engagement of the movable and stationary contacts.

It is seen that this downward movement of contact arm 70 to its open circuit position seen in FIG. 4 separates movable circuits 84 from fixed contacts 97 electrically connected to the receptacle sockets 24. As a consequence, electrical power introduced to the contact strips 70 by braids 83 wired into the distribution circuit energizing the receptacle sockets 24 is interrupted upon separation of the fixed and movable contacts. To restore electrical power to the receptacle sockets upon correction of the ground fault condition, reset operator 26 is depressed, moving the hooked lower end of latch 96 downwardly in the space between endwalls 90 and 92. During this downward progression of latch 96, arms 96*c* clear corner 114 of mounting block 48, thus enabling latch spring 112 to bias latch hook 96*a* toward the right as seen in FIGS. 4 and 6. Upon full depression of reset operator 26, latch hook 96*a* moves onto latch surface 94. Release of the reset operator permits spring 108 to overpower spring 74, and arm 70 is thus raised to its closed circuit position seen in FIG. 6.

Referring primarily to FIG. 10, base 20 is formed having a central cavity 120 for accommodating operating mechanism 40. Four wells 122 are positioned about reset operator opening 106 in the base front wall for receipt of posts 124 (FIG. 3) molded in mounting block 46, thereby positionally locating the operating mechanism within cavity 120. Opposed notches 106*a* accommodate lugs 102 during maximum protrusion of reset operator 26 through base front wall opening 106.

Each receptacle socket 24 includes a triangular array of three cavities 126*a*, 126*b* and 126*c* formed in the base interior. Cavities 126*c* accommodate the previously mentioned ground female stab connectors 35, while cavities 126*a* and 126*b* of each receptacle socket 24 accommodate female stab connectors 128*a* and 128*b*, respectively. Connectors 128*a* of the two receptacle sockets are electrically and structurally interconnected by a rigid strap 130, while connectors 128*b* are similarly interconnected by a rigid strap 132. These straps extend along one base sidewall in a front to back spaced relation best seen in FIG. 2. Strap 130 is formed with a forwardly extending strap segment 130*a* having a laterally turned terminal portion 130*b*. One stationary contact 97 is affixed to the back side of this terminal portion. Strap 132 is formed with a rearwardly extending strap segment 132*a* having a laterally turned terminal portion 132*b* coplanar with terminal portion 130*b*.

The other stationary contact 97 is affixed to the back side of terminal portion 132*b*.

It is seen from this construction that the corresponding, electrically common stab connectors 128*a* and 128*b* of the two receptacle sockets, together with their common stationary contacts 97, are fabricated as separate subassemblies for insertion in base 20. As a consequence, final assembly is greatly simplified. Also, this construction insures electrical isolation between non-corresponding socket connectors. For feed-through wiring installations, a pair of the wires emanating through the back cover are electrically connected to connectors 128a and 128b, as indicated at 129 in FIG. 10.

Figure 11:
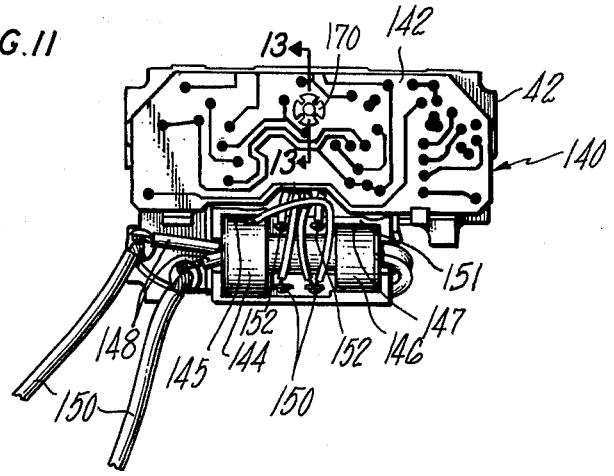
FIG. 11 is a plan view of the magnetics - electronics module incorporated in the receptacle of FIG. 1.

The back side of support plate 42 is structured to mount a GFCI module, generally indicate at 140 in FIG. 11. This module includes a circuit board 142 (FIG. 14) on which are mounted electronic components in electrical interconnection. Raised walls 151 formed with support plate 42 provide a pair of cavities in which are accommodated the magnetics of module 140, specifically a differential current transformer 144 in cavity 145 and a neutral excitation transformer 146 in cavity 147. Conductor segments 148, electrically connected via wires 150 emanating through back cover 22, are threaded through the central openings in the transformers. Windings of the transformers are brought out to terminal posts 150 for electrical connection via leads 152 to the electronics.

Circuit board 142 is supported on the ends of side posts 154, ledges 156*a* formed in posts 156 and on the shoulder 158*a* of a post 158, all integrally formed in outstanding relation from the rear side of support plate 42. An edge of circuit board 142 is caught under a short laterally extending tap 160 to retain that side of the circuit board seated on shoulders 156*a*. Neck 158*b* of post 158 is received through a hole 162 in circuit board 142 in the fashion shown in FIG. 13.

To sustain circuit board 142 in position, a unique pin fastener 164, formed of a suitable, relatively rigid plastic material such as a modified polyphenylene oxide is utilized. As seen in FIGS. 14–18, this pin fastener is formed having an elongated shank of T-shaped cross-section consisting of a cross-beam 166 and a transverse loading beam 168 joined to the cross-beam at its mid-length along the entire shank length. The shank is joined at one end to a conical head 170 which is undercut at 171 to provide an annular shoulder 172. Head 170 is also slotted, as indicated at 170*a*, to provide a plurality of resilient webs 175.

Once the circuit board 142 is seated on shoulder 158*a* of post 158, pin fastener 164 is press-fitted into a central bore 158*c* in post 158. Initial insertion of the pin fastener is facilitated by a slight taper 164*a* formed in the leading end of its shank.

Figures 14, 15, 16, 17, 18:
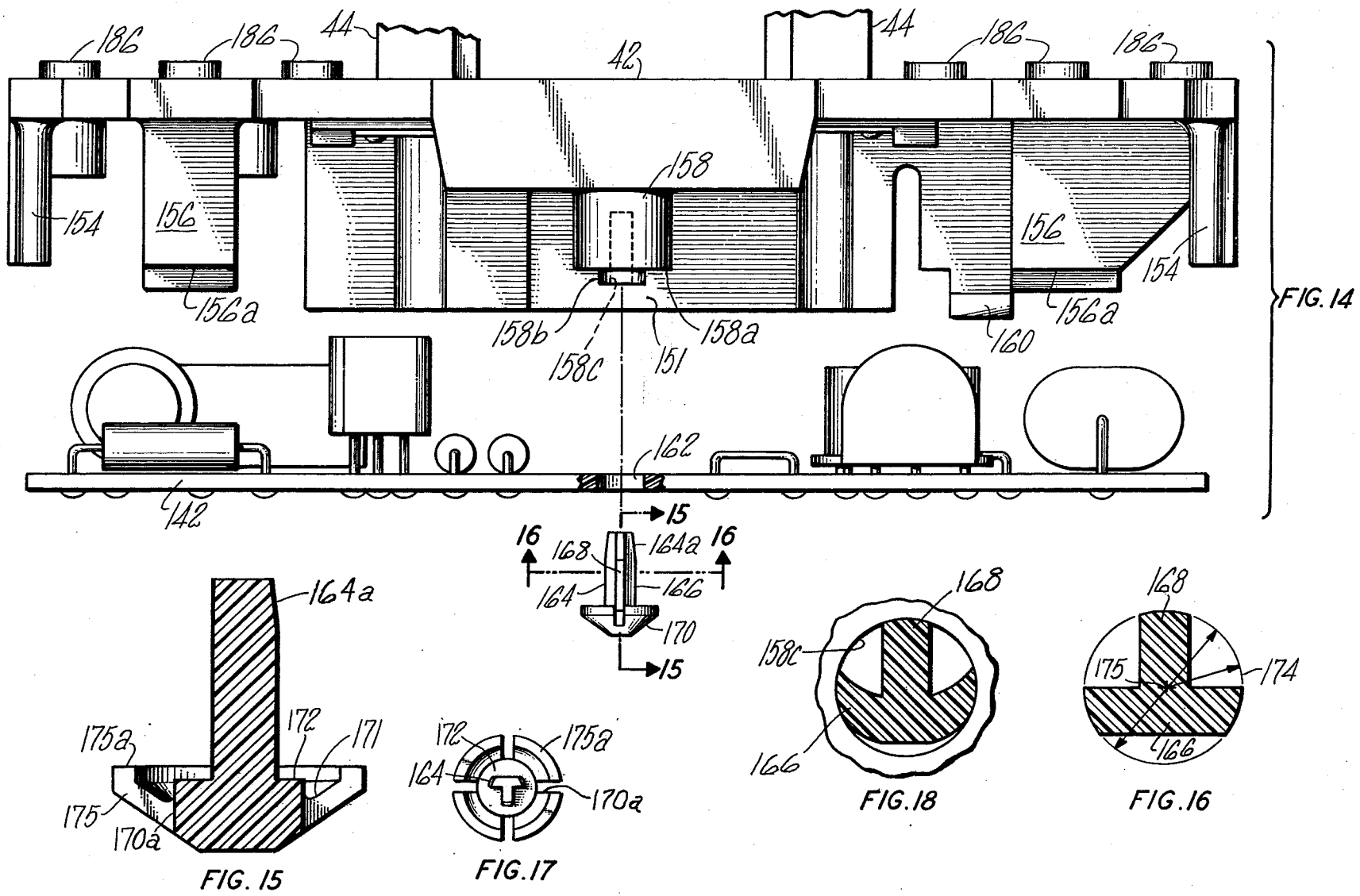
FIG. 14 is an exploded side elevational view illustrating the mounting within the receptacle of the module of FIG. 11.
FIG. 15 is an enlarged sectional view of the pin fastener of FIG. 14; taken along line 15—15.
FIG. 16 is an enlarged sectional view of the pin fastener of FIG. 13, taken along line 16—16.
FIG. 17 is an end view of the pin fastener of FIG. 14.
FIG. 18 is a transverse sectional view illustrating the operation of the pin fastener in securing the circuit board to the support plate of FIG. 14.

As best seen in FIG. 18, with insertion of the pin fastener in bore 158*c*, the exposed edge surfaces of beams 166 and 168, in engaging the bore sidewall, cause cross-beam 166 to flex. Proper flexure or loading of beam 166 is insured by loading beam 168. Under such flexure, crossbeam 166 constitutes an exceptionally powerful spring effective to achieve strong frictional engagement of the pin fastener in bore 158c, and thus hold the circuit board seated on post shoulder 158*a* despite even rough handling of the receptacle. Yet, the pin fastener can be removed for servicing and replacement of the electronics.

Figure 13:
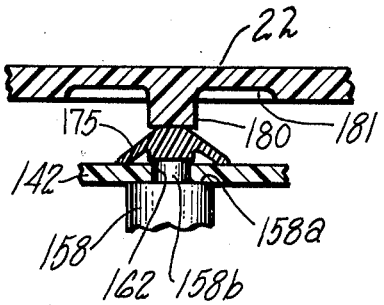
FIG. 13 is a fragmentary sectional view taken along line 13—13 of FIG. 11 with addition of a portion of the rear cover of FIG. 12.

To maximize the surface area of frictional engagement of pin fastener 164 in bore 158*c*, the exposed surfaces of the beams are preferably formed (FIG. 16) as arcuate segments lying on a common circle 174 whose center 175 lies on the mid-line of beam 168 at the junction of the beams. The dimensional relationship of the diameter of circle 174 to the diameter of bore 158*c* depends in large measure on the thickness of beam 166, its length in relation to the thickness of beam 168 and the resiliency of the shank material. It has been found that for bore diameters less than 0.100 inches, adequate frictional engagement of pin fastener 164 in bore 158*c* is achieved when the diameter of circle 174 is a mere 0.001 inches larger than the bore diameter. As seen in FIGS. 13 and 15, the free, arcuate edges 175*a* of web 175 lie below shoulder 172 of pin fastener 164. Consequently, with the circuit board 142 in position on shoulder 158*a* of post 158 with the neck 158*b* of the post extending through opening 162 in the circuit board and the pin fastener 164 inserted in bore 158*c* to the extent that pin shoulder 172 seats on the end of neck 158*d*, the webs 185 are flexed to resiliently hold the circuit board in position during assembly of the receptacle.

Figure 12:
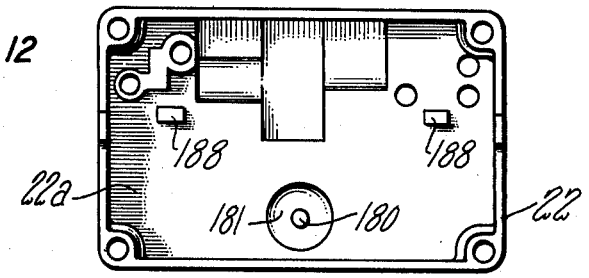
FIG. 12 is a plan view of the rear cover for the receptacle of FIG. 11.

Referring to FIG. 12, it is seen that the rear cover 22 is formed with a post 180 inwardly outstanding from the cover back wall 22*a*. The cover material surrounding this post is of reduced thickness to provide a resilient web 181, joining the post to the cover backwall 22*a*. Thus, when the cover is joined with base 20, post 180 is positioned to bear against the head 174 of pin 164 as seen in FIG. 12. Resilient web 181 permits post 180 to yield so as not to impose undue forces on pin fastener 164 which could crack circuit board 142. It will also be appreciated that the inclusion of resilient web 181 eases manufacturing tolerance requirements.

From the description thus far, it is seen that the module 140 is mounted to the back side of support plate 142, with pin fastener 164 sustaining circuit board 142 in position. Operating mechanism 40 is formed and mounted to the front side of support plate 42 with rivets 52. After all the electrical connectors have been made, the support plate is inserted in base 20. One elongated edge of the support plate is supported on a recessed ledge 184 seen in FIG. 10. Raised buttons 186, seen in FIGS. 3 and 5, bear against socket connectors 35, 128*a* and 128*b* to both support the plate and to provide backing for resisting the insertion forces incident to the plugging in of appliance cord plugs. Further backing against plug insertion forces is provided by posts 188 outstanding from the back cover 22 (FIG. 12) which bear against the ends of posts 156 (FIG. 14) carried by the support plate. As seen in FIGS. 3, 5 and 11, three corners of support plate 42 are notched, as indicated at 190, so as to provide clearance for screws 192 (FIG. 3) holding the base and cover together, and yet are seated on the ends of the corner fillets 194 of the base and cover through which the screws pass; the ends of the base fillets being recessed to the plane of ledge 184. Thus, when the base and cover are joined, three corners of the support plate are clamped between the registered base and cover fillets to insure a secured operational position.

It will thus be seen that the objects set forth above, among those made apparent in the preceding description, are efficiently attained and, since certain changes may be made in the above construction without departing from the scope of the invention, it is intended that all matter contained in the above description or shown in the accompanying drawings shall be interpreted as illustrative and not in a limiting sense.

Having described my invention, what I claim as new and desire to secure by Letters Patent is:

1. An electrical receptacle equipped to provide ground fault protection, said receptacle comprising, in combination:

A. insulative, generally rectangular housing consisting of
   1. a base having sidewalls and providing a housing front wall, and
   2. a cover having sidewalls and providing a housing rear wall;

B. a pair of spaced sockets, each including
   1. a pair of slots formed in said housing front wall, and
   2. a stab connector within said housing aligned with each said slot for achieving electrical contacting engagement with the prongs of an appliance cord plug inserted through said slots;

C. means forming a separate cavity in said base accommodating each said connector:

D. a pair of elongated, rigid busbars, each said busbar having its ends affixed to corresponding connectors of each said sockets;

E. a conductive strap affixed to each said busbar at locations intermediate their ends and extending transversely therefrom;

F. a stationary contact carried by each said strap adjacent its free end;

G. an operating mechanism mounted within said housing, said mechanism including
   1. a pair of movable contacts, and
   2. an arm carrying said movable contacts for movement between positions of electrical engagement and disengagement with respect to said stationary contacts, and H. a GFCI module within said housing and controlling said operating mechanism such as to achieve disengagement of said stationary and movable contacts in the event of a ground fault.

2. The electrical receptacle defined in claim 1, which further includes a support plate clamped between said base and cover when joined to form said housing, said plate mounting said operating mechanism and said GFCI module.

3. The electrical receptacle defined in claim 2, wherein said plate is positioned within said housing in spaced parallel relation to said front wall thereof, the surface of said plate facing said front wall formed having proturberances positioned to provide physical backing for said socket connectors.

4. The electrical receptacle defined in claim 3, wherein said plate is formed having posts upstanding from its surface facing said rear wall, and said rear wall formed having protuberances positioned to bear against the terminations of said posts to enhance the physical backing for said socket connectors.

5. The receptacle defined in claim 1, wherein each said socket includes an additional slot in said front wall and an additional stab connector within said housing aligned with said additional slot to achieve electrical engagement with the grounding pin of an appliance cord plug inserted through said additional slot.

6. The receptacle defined in claim 5, which further includes a conductive mounting plate affixed to said base, said mounting plate electrically connected to each said additional connectors.

7. The receptacle defined in claim 6, wherein said mounting plate includes tabs extending through aligned openings in said base and said additional connectors, the terminal portions of said tabs being staked to affix said mounting plate and said additional connectors to said base.

* * * * *